United States Patent [19]

Lee

[11] Patent Number: 4,995,617

[45] Date of Patent: Feb. 26, 1991

[54] ARTICLES OF PLAY FOR USE IN THE GAME OF CATCH

[76] Inventor: Miryoung Lee, 1034 E. Walnut Creek Pkwy., West Covina, Calif. 91790

[21] Appl. No.: 490,301

[22] Filed: Mar. 8, 1990

[51] Int. Cl.[5] ..... A63B 67/00

[52] U.S. Cl. ..... 273/346; 273/DIG. 30

[58] Field of Search ..... 273/346, DIG. 24, 412, 273/DIG. 30, 19

[56] References Cited

U.S. PATENT DOCUMENTS

| | | | |
|---|---|---|---|
| 716,645 | 12/1902 | Ransom | 273/DIG. 24 |
| 3,032,345 | 5/1962 | Lemelson | 273/346 |
| 3,601,406 | 8/1971 | Glass | 273/DIG. 30 X |
| 3,857,566 | 12/1974 | Lemelson et al. | 273/346 |
| 3,917,271 | 11/1975 | Lemelson et al. | 273/346 |
| 3,927,881 | 12/1975 | Lemelson et al. | 273/58 K |
| 3,999,748 | 12/1976 | Clarke | 273/346 |
| 4,017,076 | 4/1977 | Bai | 273/346 |

FOREIGN PATENT DOCUMENTS

| | | |
|---|---|---|
| 5911 | 1/1986 | Rep. of Korea . |
| 89-22590 | 12/1989 | Rep. of Korea . |

*Primary Examiner*—William H. Grieb

*Attorney, Agent, or Firm*—Lieberman Rudolph & Nowak

[57] ABSTRACT

Articles of play for use with the game of catch including a ball covered with VELCRO material and a multi-layer catcher's mitt with a front layer also covered in mating VELCRO material. The multi-layer mitt includes a rigid concave rear layer, a first intermediate flexible layer, a second intermediate flexible layer, and said front layer of VELCRO material.

4 Claims, 3 Drawing Sheets

FIG.4
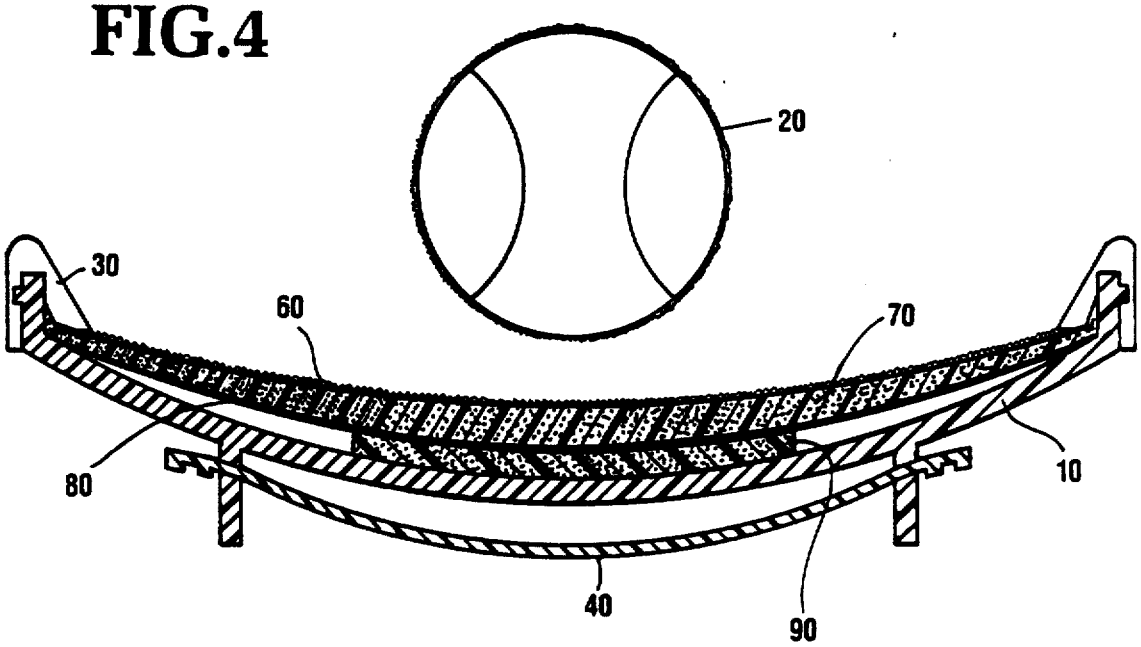
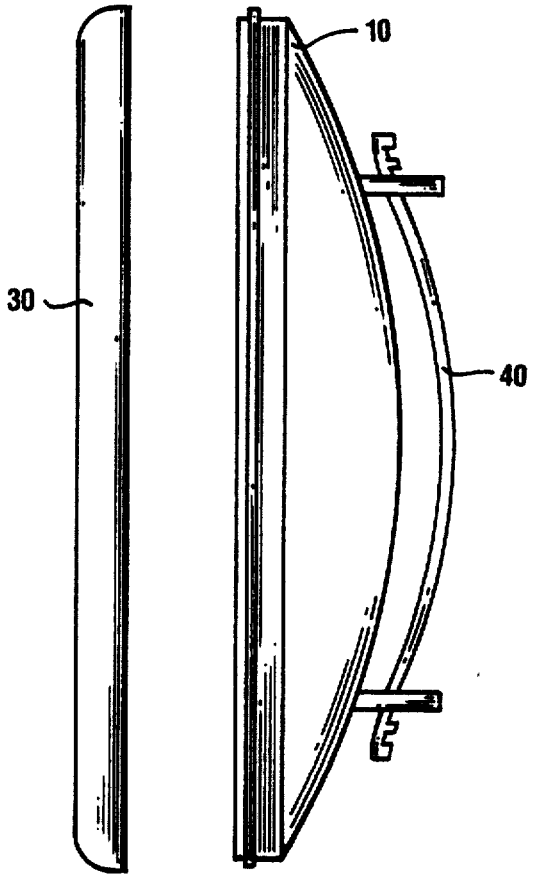
FIG.5

ARTICLES OF PLAY FOR USE IN THE GAME OF CATCH

FIELD OF THE INVENTION

This invention relates to articles of sport and play and, more particularly, to unique articles for playing the game of catch, which articles are particularly useful for use with young children, as well as adult players.

BACKGROUND OF THE INVENTION

The game of catch has been played since antiquity, both as a form of play and, in more recent times, as part of a sport such as baseball, etc. As is well known, the game is played by tossing a ball (or any similar article) back and forth between two or more players, which players may catch the ball with their bare hands, or with the aid of a baseball glove, or the like.

Although throwing and catching an object, such as a ball, is enjoyable and quite easy for older children or adults, a surprising amount of coordination is required to successfully play the game, which coordination is sometimes lacking in younger children still in the early stages of physical development. Therefore, although younger children are generally quite eager to attempt playing the game of catch or related sports activities, they may soon become frustrated in their efforts due to their inability to successfully catch the ball.

It is, therefore, an object of the instant invention to simplify the game of catch so that the game is easily played by younger children.

It is another object of the instant invention to simplify the game of catch by providing play articles which permit a young child to easily catch a thrown object, such as a ball, through use of a unique catching aid.

In accordance with one aspect and feature of the instant invention, unique play articles are provided for playing the game of catch, which play articles include a catcher's aid, such as a glove type article, with a front surface covered in a hook and loop type fastening material such as VELCRO (registered trademark of The Velcro Manufacturing Co.), along with a ball whose entire surface area may also be covered in similar material whereby the ball is easily caught by the catcher's glove due to the attachment action of the hook and loop type fastening material.

Prior art patents exist in which mating sections of VELCRO, or VELCRO material, are used to facilitate adherence of an object to the front surface of a play article.

One of the earliest of said patents is U.S. Pat. No. 3,032,345, issued on May 1, 1962 to Jerome H. Lemelson. The '345 Lemelson patent was directed to a dart game in which the front surface of the dart, and the front surface of the target, were covered with VELCRO material. Therefore, when the dart was thrown at the target, the dart would attach to the target, simulating play as with an actual game of darts, but without the danger of using steel tipped darts.

A second Lemelson patent, U.S. Pat. No. 3,857,566, was issued on Dec. 31, 1974, and is directed to solving the problem of the dart disengaging from the target area due to the inherent bounce of the dart upon impact on the target. The "bounce problem" was addressed in the '566 patent by stretching VELCRO material over a frame, which frame maintained a predetermined distance between the VELCRO material and the wall on which the frame was to be hung. Therefore, during the initial impact stage of the head of the dart against the flexible VELCRO material, the dart decelerates, without bounce, thereby preventing disengagement between the dart and the target.

Although the '566 patent addressed the "bounce problem", it did so by providing a frame structure over which the VELCRO material was stretched. Such a solution is clearly unsatisfactory for play articles to be used in the game of catch or other baseball like games.

A similar patent directed specifically to the game of catch is U.S. Pat. No. 3,999,748, issued to William A. Clarke on Dec. 28, 1976. This reference is directed to play articles useful in the game of catch, comprising a ball coated with VELCRO material, and a mitt or glove having an outer face also covered with VELCRO material. The mitt or glove is a multi-layer device, consisting of a facing layer of VELCRO material, a flexible textile backing layer, and an intermediate plastic foam layer sandwiched between the backing layer and the facing layer. The entire multi-layer device is flexible in nature, without rigid parts, which construction, although not mentioned in the '748 patent, might tend to somewhat reduce the "bounce problem". However, it is clear that the flimsy construction of the mitt described in the '748 patent would prohibit any "hard thrown" balls due to inadequate padding and, moreover, the flexible nature of the entire glove would result in constant movement on the hand, which would make the glove very difficult for use with young children.

It is, therefore, an object of the instant invention to provide articles of play for use with the game of catch, which articles are somewhat rigid and, thus, easily used with young children, while at the same time completely eliminating the "bounce problem".

It is a further object of the instant invention to provide articles of play for use in the game of catch, which articles of play can be used with young children, but also capable of absorbing the high energy of hard thrown balls without bounce or injury to the hand and, therefore, useful with adults as well.

SUMMARY OF THE INVENTION

In accordance with a first aspect and feature of the instant invention, articles of play for use with the game of catch comprise a ball having at least a portion of its surface defined by a multitude of irregular filamentary formations, such as, for example, being provided by VELCRO material.

In accordance with another feature of the instant invention, a multi-layer mitt is provided for each participant in the game of catch, the mitt including a rigid concave rear layer, a first intermediate flexible layer, a second intermediate flexible layer, and a front layer having at least a portion of its front surface covered with VELCRO material.

It is another feature of the invention that the adhesive qualities of the VELCRO material present both on the ball and the multi-layer mitt, permit the game of catch to be readily played by very young individuals lacking advanced physical coordination.

It is a still further feature of the invention that the use of said first and second intermediate flexible layers completely eliminate "bounce" when the ball strikes the mitt and also provides, in conjunction with the rigid rear layer, extensive hand protection, thereby allowing adults to play the game of catch wherein the ball can be thrown with great force and easily caught.

These and other objects and features of the invention will be more fully appreciated from the following detailed description when taken in conjunction with the accompanying drawings in which:

BRIEF DESCRIPTION OF THE DRAWINGS

FIG. 4 is a first side view of a mitt used with the instant invention, also illustrating the VELCRO layer covering on the ball; and FIG. 5 is a second side view of the inventive mitt illustrating use of a retaining ring in accordance with the instant invention.

DETAILED DESCRIPTION OF THE INVENTION

Figure 1:
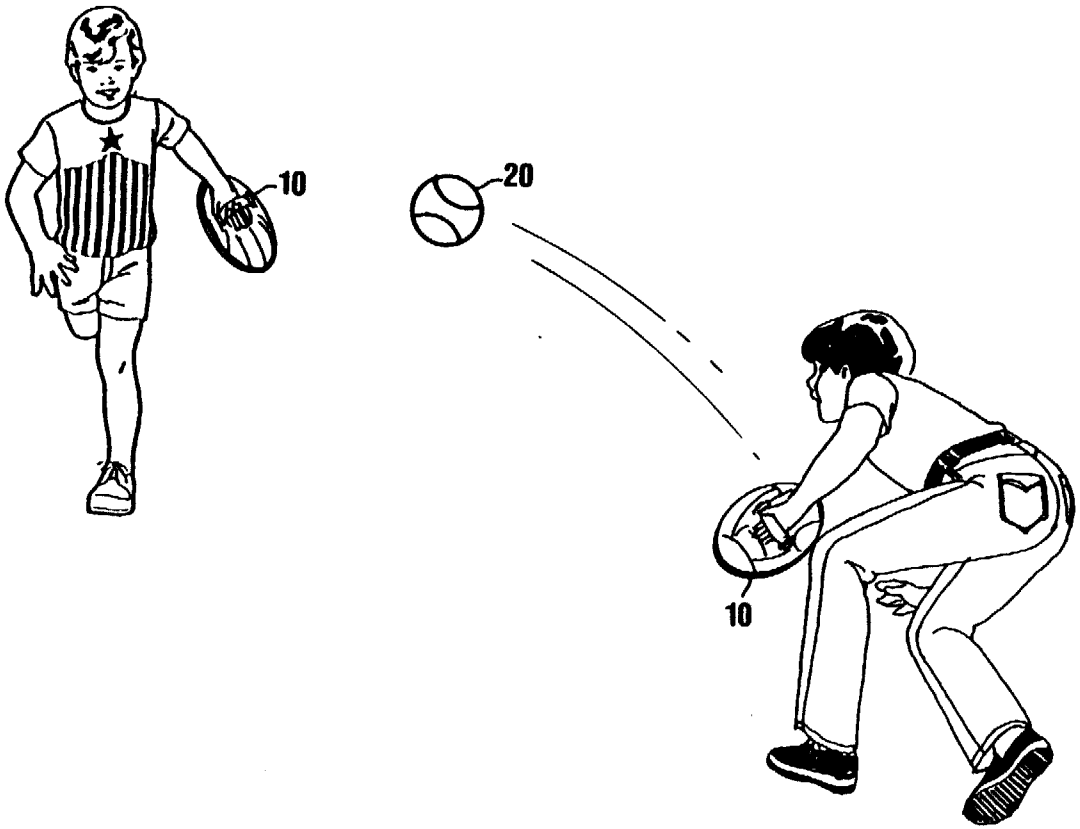
FIG. 1 illustrates use of the instant invention while being utilized by children for playing the game of catch.

Referring now to FIG. 1, there is shown two young children engaging in a game of catch, while using articles of play in accordance with the instant invention. Each child has on his left hand the "catcher's mitt 10" which, as described above, has a front surface covered with a multitude of irregular filamentary formations such as VELCRO material. Ball 20 is also covered with a mating surface of irregular filamentary formations, such as VELCRO strips so that the ball will adhere to the catcher's mitt when thrown by each child.

Figure 2:
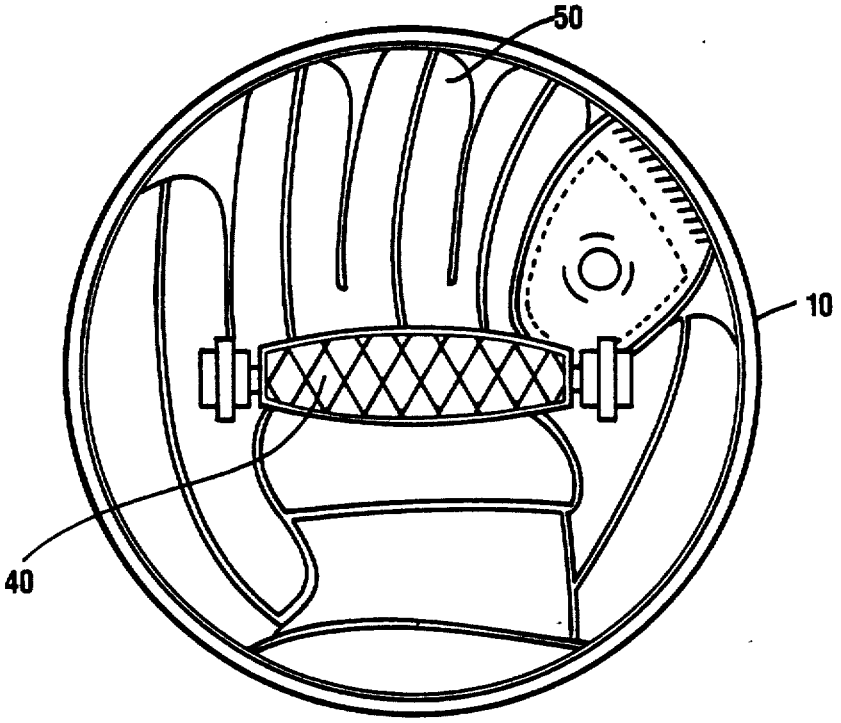
FIG. 2 is a rear view of the mitt used with the instant invention.
Figure 3:
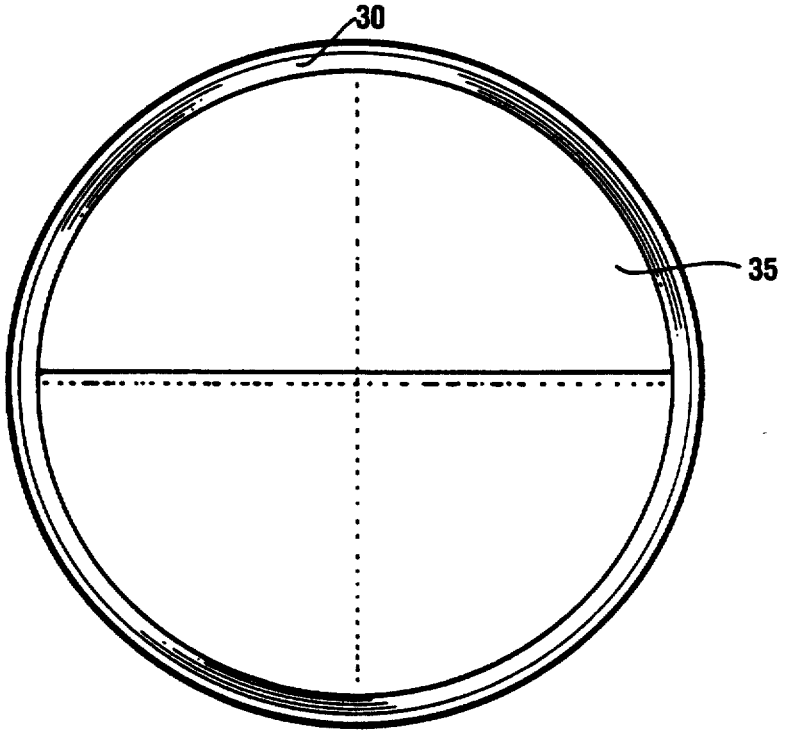
FIG. 3 is a front view of the mitt used with the instant invention.

FIGS. 2 and 3 illustrate a front and back view of the catcher's mitt. The rear layer 50 for the mitt is made of a polyethylene material, which is very strong and makes the mitt nearly impossible to break under strong impacts. It is to be understood that the polyurethane material can have formed in the surface thereof the shape of an actual catcher's mitt or, of course, other shapes could be utilized.

The player engages the mitt by inserting his, or her, hand under handle 40, which handle can be adjustable to fit hands of various sizes. FIG. 3 illustrates the front surface of the mitt which, as described above, has a covering of VELCRO at area 35, which covers the entire surface of the mitt. The VELCRO covering is retained in place in a manner to be described below, with the edges of the VELCRO being restrained by retaining ring 30.

FIG. 4 illustrates a side view of the mitt, along with ball 20. As described, ball 20 is completely covered with a VELCRO layer for adhesion to the VELCRO front surface of the catcher's mitt. The VELCRO front surface consists of a layer of VELCRO material 60 behind which is inserted a foam layer 70, preferably of a thickness approximating one-third inch, which foam layer is backed by a cotton fabric layer 80. Beneath the cotton fabric layer 80 is a second flexible foam layer 90, which preferably occupies an area approximately 3.5 inches square, and is arranged to lie within the approximate center of the catcher's mitt. The foam material utilized is preferably polyurethane foam for both layer 90 and layer 70. It is, of course, understood that layers 70 and 90 could be combined into a single foam layer. The total distance between layer 60 and the rear layer of the mitt 50, is in the range of between one-fourth and two inches. Similarly, if the mitt is circular, its diameter is between six and twelve inches.

Preferred methods of construction include layer 90 being glued to the rear layer of mitt 10 and, thereafter, gluing cotton fabric layer 80 over layer 90, and also gluing layer 80 to the rear layer of mitt 10. Foam layer 70 is sewed to cotton layer 80 and, thereafter, VELCRO layer 60 is sewed to foam layer 70. Use of the cotton fabric substantially prevents the foam layers from separation, and makes the foam layers much more durable under repeated impacts from ball 20.

FIG. 5 illustrates a side view of the catcher's mitt illustrating handle 40, mitt 10 and retaining ring 30. The purpose of retaining ring 30 is to ensure that the VELCRO layer does not separate when ball 20 is removed from mitt 10.

It should also be understood that various portions of the mitt or ball could be made of various colors, and/or made of phosphorescent material for exciting night-time play.

The advantage of the instant invention is the use of foam layers 70 and/or 90, which layer, or layers, are designed to substantially absorb any impact by the ball during the game of catch, and thus prevent disengagement between the ball and the mitt. Due to the fact that the foam layer(s) absorb approximately 60% of the impact of the ball, the ball will consistently adhere to the VELCRO front layer of the catcher's mitt, thereby insuring a successful game of catch for young children and other relatively uncoordinated individuals.

In addition, the foam layer(s) completely eliminate any "bounce problem", as well as providing adequate hand protection so that the inventive articles of play can accommodate hard thrown balls fielded by adult players.

The foregoing disclosure and description of the invention is illustrative and explanatory thereof and various changes in the size, shape and materials, as well as in the details of the illustrated constructions, may be made within the scope of the appended claims without departing from the spirit in the invention.

I claim:

1. Articles of play or sport, for use with the game of catch, comprising:

a missile having substantially all of its surface defined by a multitude of irregular filamentary formations, and a multi-layer mitt for use by each participant in the game of catching said missile, said multi-layer mitt including a rigid concave rear layer, a first intermediate flexible layer, a second intermediate flexible layer, and a front layer having substantially all of its front surface defined by a multitude of irregular filamentary formations, said first intermediate flexible layer occupying a surface area less than the surface area of said rear layer, and said second intermediate flexible layer occupying a surface area substantially equal to the surface area of said rear layer, said front layer being retained in place by a retaining ring with an inner edge of said retaining ring extending over a portion of said front layer, whereby said front layer is prevented from separating from said second intermediate flexible layer.

2. Articles of play or sport, in accordance with claim 1, wherein said multi-layer mitt has means incorporated into said concave rear layer for enabling each participant in the game of catch to grab said mitt in one of said participant's hands.

3. Articles of play or sport, in accordance with claim 2, wherein said first and second intermediate layers are comprised of polyurethane foam.

4. Articles of play or sport, in accordance with claim 1, wherein the distance between said rear layer and said front layer is between one-fourth and two inches, and wherein said multilayer mitt is circular with a radius of between six and twelve inches.

* * * * *